US008317942B2

(12) United States Patent
Pelsoeczy et al.

(10) Patent No.: US 8,317,942 B2
(45) Date of Patent: Nov. 27, 2012

(54) LEDEBURITE CAST IRON WITH A HIGH CARBIDE CONTENT AND AN EVENLY DISTRIBUTED GRAPHITE EMBODIMENT

(75) Inventors: Laszlo Pelsoeczy, Burscheid (DE); Wilfried Langner, Friedberg (DE); Hans-Henning Zutz, Wermelskirchen (DE); Thomas Gerle, Augsburg (DE); Franz-J. Goebbeis, Burscheid (DE)

(73) Assignee: Federal-Mogul Friedberg GmbH, Friedberg (DE)

( * ) Notice: Subject to any disclaimer, the term of this patent is extended or adjusted under 35 U.S.C. 154(b) by 639 days.

(21) Appl. No.: 11/817,752

(22) PCT Filed: Feb. 8, 2006

(86) PCT No.: PCT/EP2006/001103

§ 371 (c)(1),
(2), (4) Date: May 13, 2009

(87) PCT Pub. No.: WO2006/094591

PCT Pub. Date: Sep. 14, 2006

(65) Prior Publication Data

US 2011/0094632 A1 Apr. 28, 2011

(30) Foreign Application Priority Data

Mar. 4, 2005 (DE) ..... 10 2005 010 090

(51) Int. Cl.
*C22C 37/06* (2006.01)
*C21D 5/00* (2006.01)

(52) U.S. Cl. ..... 148/324; 148/321

(58) Field of Classification Search ..... 148/324, 148/322

See application file for complete search history.

(56) References Cited

U.S. PATENT DOCUMENTS

| | | | | |
|---|---|---|---|---|
| 4,153,477 | A * | 5/1979 | Beyer et al. | 148/545 |
| 5,230,382 | A * | 7/1993 | Swars | 164/477 |
| 5,514,065 | A * | 5/1996 | Noda et al. | 492/58 |
| 2004/0214030 | A1 | 10/2004 | Windhager | |

FOREIGN PATENT DOCUMENTS

| | | | |
|---|---|---|---|
| DE | 26 18 775 | A1 | 11/1977 |
| DE | 100 49 598 | A1 | 4/2002 |
| DE | 103 09 386 | | 9/2004 |

* cited by examiner

*Primary Examiner* — Jie Yang

(74) *Attorney, Agent, or Firm* — Robert L. Stearn; Dickinson Wright, PLLC

(57) ABSTRACT

A cast iron material, particularly a ledeburitic cast iron material with a carbide content of at least 15 wt. % and a characteristic free, evenly distributed graphite formation is disclosed. In this case, the evenly distributed graphite formation may comprise graphite flakes and/or vermicular graphite and/or nodular graphite. Depending on the respective application (diameter (D) of the running gear seal, peripheral speed), the basic matrix may be realized in pearlitic and/or bainitic and/or martensitic form. Due to the high graphite content, the material has a thermal conductivity that is three to four times greater than that of white cast iron materials, wherein this provides the advantage that no scoring of the running gear seals occurs at high peripheral speeds (>5 m/s) and large diametrical dimensions of the seals (D >600 mm). In addition, the high carbide content of at least 15 wt. % provides an adequate wear resistance, and other alloying elements such as chromium, vanadium, molybdenum and nickel provide the material with a corresponding corrosion resistance. The aforementioned ledeburitic cast iron material with evenly distributed graphite formation can be used, for example, for the manufacture of axial face seals and cylinder liners.

8 Claims, 5 Drawing Sheets

FIG. 1
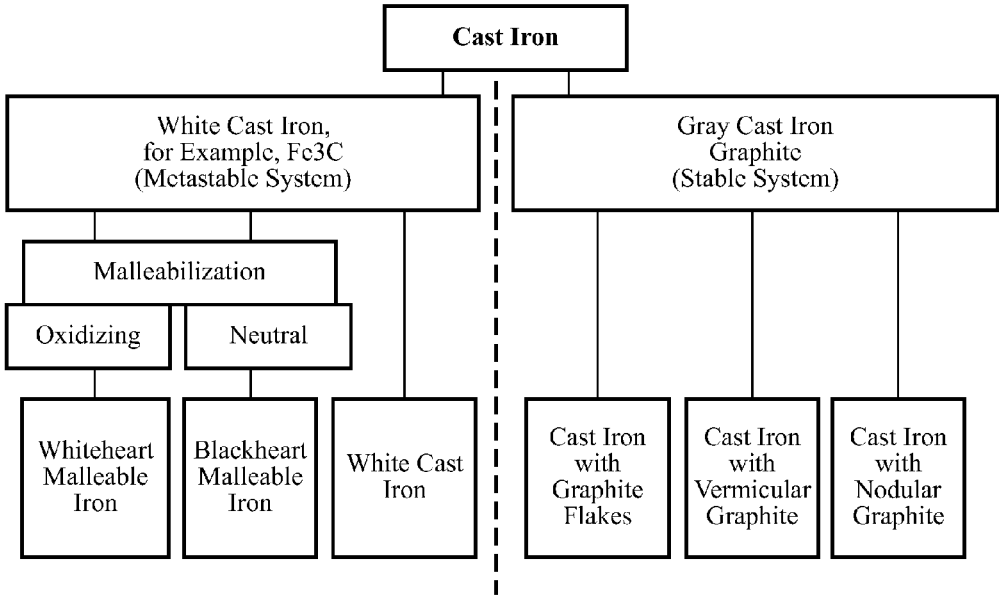
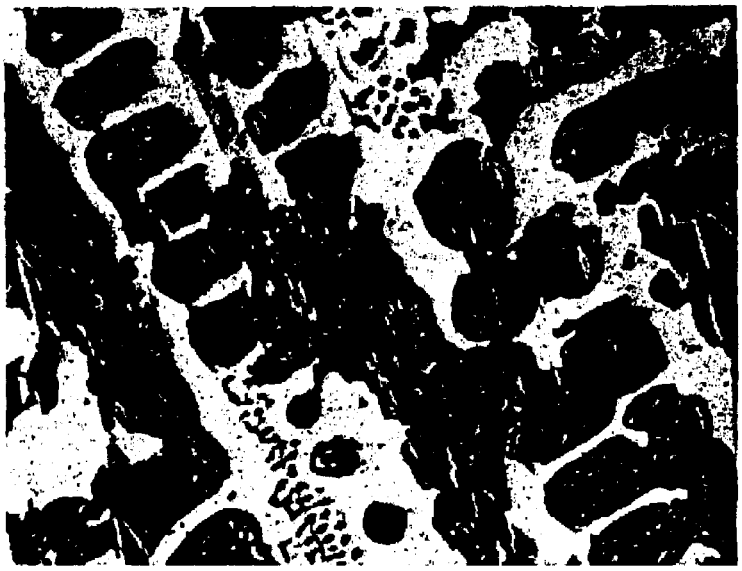
FIG. 2
100:1 ⊢50 μm⊣
Ledeburite with Martensite (Ni Hard 1)

100:1 ⊢50 μm⊣

Objective: Ledeburite with Martensite and Graphite Flakes (schematic)

Hardness: 32 HRC

| C% | Si% | Mn% | P% | S% | Cr% | Ni% | Mo% | V% | Cu% |
|---|---|---|---|---|---|---|---|---|---|
| 4,1 | 1,7 | 0,6 | 0,4 | 0,08 | 1,7 | 2 | 0 | 0,3 | 0 |

100:1 Unetched; Graphite Formation

500:1 Etched with Nital
White: Carbide of the Ledeburite
Gray: Pearlite of the Ledeburite
Black: Graphite Hardness: 49 HRC

| C% | Si% | Mn% | P% | S% | Cr% | Ni% | Mo% | V% | Cu% |
|---|---|---|---|---|---|---|---|---|---|
| 4,2 | 1,7 | 0,6 | 0,4 | 0,08 | 3 | 3 | 0,9 | 0,35 | 0 |

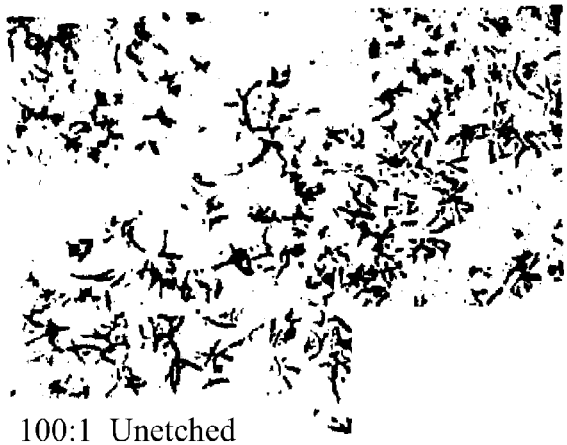
FIG. 9
100:1 Unetched
Graphite Formation
FIG. 10
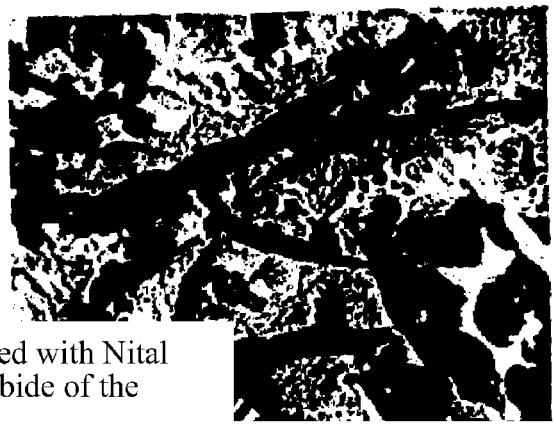
500:1 Etched with Nital
White: Carbide of the Ledeburite
Bright Gray: Bainite and Martensite of the Ledeburite
Black: Graphite and Ribbon-Grained Pearlite
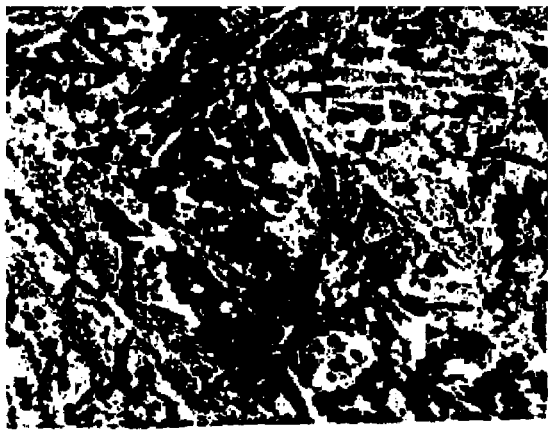
FIG. 11
200:1 Etched with Nital
White: Carbide of the Ledeburite
Bright Gray: Bainite and Martensite of the Ledeburite
Black: Graphite and Ribbon-Grained Pearlite

LEDEBURITE CAST IRON WITH A HIGH CARBIDE CONTENT AND AN EVENLY DISTRIBUTED GRAPHITE EMBODIMENT

BACKGROUND OF THE INVENTION

1. Technical Field

The present invention pertains to a cast iron material. The present invention specifically pertains to a ledeburitic cast iron material with free, evenly distributed graphite formation and a high carbide content of at least 15 wt. % which can be used for the manufacture of sliding rings for use in running gear seals or cylinder liners of engines.

2. Related Art

State of the Art

Running gear seals that run with high peripheral speeds (>5 m/s) are required more and more frequently in technical applications. The materials used nowadays such as, for example, Ni-Hard cannot fulfill the corresponding requirements with respect to high peripheral speeds at larger dimensions (D>600 mm). The frictional heat generated on the contact surfaces of the sliding rings cannot be carried off sufficiently fast due to the insufficient thermal conductivity of the material and scoring occurs. This destroys the sealing surfaces and results in impermissible leakage.

According to the state of the art, hardened high-alloy and unalloyed steel, as well as stellites, cast nickel, various white cast iron and cast iron materials such as, for example, Ni-Hard and gray cast iron are used in the manufacture of running gear seals.

In special applications in which the diameter (D) of the seal exceeds 600 mm, steel materials are not used for reasons of manufacturing and application technology because, among other things, the maximum attainable peripheral speed lies below 4 m/s in this case.

In the special field of applications in which the diameter (D) of the seal exceeds 600 mm, for example, a white cast iron material such as Ni-Hard 1 is used, but the peripheral speed of this material is limited to 5 m/s.

Another material such as, for example, siculite (gray cast iron) has inferior wear and corrosion characteristics in comparison with (Ni-Hard 1) and therefore is used rather rarely, particularly for the cited reasons.

The problem of optimal wear and corrosion resistances, thermal conductivity and absence of leakages in connection with high peripheral speeds (>5 m/s) of ring seals in the diameter range (D>600 mm) has not been solved so far for the application in axial face seals and/or cylinder liners.

SUMMARY OF THE INVENTION

The present invention therefore is based on the objective of making available a cast iron material for the manufacture of wear-resistant and corrosion-resistant axial face seals or cylinder liners with high thermal conductivity, namely for use at high peripheral/running speeds (>5 m/s) and large diameters (D>600 mm).

According to the invention, this objective is attained with a ledeburitic cast iron material with free graphite formation and a carbide content of at least 15 wt. %.

The carbon present in the material is either formed freely, i.e., it is present in the form of graphite in spatially distributed, concentrated accumulations or regions, or bound in the ledeburite as cementite or as carbides or special carbides in the form of $Fe_3C$ or $Me_xC_y$.

Depending on the respective application, the basic matrix of the cast iron material made available by the invention may be realized in pearlitic and/or bainitic and/or martensitic form.

Due to the freely distributed graphite formation, the material made available by the invention has a thermal conductivity that is three to four times greater than that of white cast iron materials.

A superior thermal conductivity in comparison with white cast iron materials such as Ni-Hard is achieved with the material made available by the invention such that the frictional heat of the sliding surfaces in running gear seals can be carried off in a correspondingly improved fashion. A thermal destruction of the lubricating film, as well as the associated scoring of the contact surfaces, therefore is also prevented at peripheral speeds=>5 m/s.

According to another aspect of the present invention, the inventive material of ledeburitic cast iron with free, preferably evenly distributed graphite formation and a carbide content of at least 15 wt. % is realized in such a way that its composition consists of:

2.5-5.0 wt. %, preferably 4.1-5.0 wt. %, carbon (C),
1.0-3.0 wt. %, preferably 1.0-1.8 wt. %, silicone (Si),
no more than 1.0 wt. %, preferably 0.6-1.0 wt. %, manganese (Mn),
no more than 0.8 wt. %, preferably 0.5 wt. %, phosphorus (P),
no more than 0.3 wt. %, preferably 0.1 wt. %, sulphur (S),
no more than 10.0 wt. %, preferably 4.0 wt. %, chromium (Cr),
no more than 3.0 wt. %, preferably 1.0 wt. %, copper (Cu),
no more than 3.0 wt. %, preferably 1.0 wt. %, molybdenum (Mo),
no more than 0.25 wt. %, preferably 0.2 wt. %, tin (Sn),
no more than 4.0 wt. %, preferably 3.0 wt. %, nickel (Ni),
no more than 3.0 wt. %, preferably 0.5 wt. %, vanadium (V), as well as
iron and manufacturing-related impurities as the remainder.

It is also preferred that the ledeburitic cast iron with free graphite formation is a "mixture" of white cast iron (Ni-Hard 1) and gray cast iron.

It is furthermore preferred that the graphite formation of the ledeburitic cast iron made available by the invention is present in the form of graphite flakes.

It is also preferred that the graphite of the ledeburitic cast iron made available by the invention is present in the form of vermicular graphite.

It is furthermore preferred that the ledeburitic cast iron made available by the invention has a pearlitic basic matrix.

According to another embodiment of the present invention, it is preferred that the ledeburitic cast iron has a bainitic and/or martensitic basic matrix.

In the ledeburitic cast iron made available in accordance with the invention, it is furthermore preferred that the hardening and/or annealing of the ledeburitic cast iron is carried out by means of conventional heat treatment processes.

According to another aspect of the present invention, it is preferred that the ledeburitic cast iron according to the present invention is nitride-hardened and/or coated by means of conventional processes and materials (e.g., Cr, CKS, PVD, . . . etc.).

It is also preferred that the material made available by the invention is used for the manufacture of sliding rings in running gear seals.

It is furthermore preferred that the aforementioned material is used for the manufacture of cylinder liners.

It is also preferred to utilize the material for the manufacture of any sealing elements in running gear seals.

According to another aspect of the present invention, it is preferred to utilize the material as a sealing element in running gear seals with high peripheral speeds (>5 m/s) and/or large running gear seal diameter (>600 mm).

BRIEF DESCRIPTION OF THE FIGURES

Other advantages, characteristics and possible applications of the present invention result from the following description of preferred embodiments with reference to the figures.

FIG. 1 shows an overview diagram of possible cast iron formations.

FIG. 2 shows a micrograph detail of ledeburite with martensite formation (Ni Hard 1) on a scale of 100:1.

FIG. 9 shows an unetched micrograph according to the embodiment of FIG. 8 of the ledeburitic cast iron material according to the embodiment of FIG. 8 which as a hardness of 49 HRC, as well as a corresponding evenly distributed graphite formation, namely on a scale of 100:1.

FIG. 10 shows a nital-etched micrograph according to the embodiment of FIG. 8 of a ledeburitic cast iron material according to the embodiment of FIG. 8 which has a hardness of 49 HRC, namely on a scale of 500:1.

FIG. 11 shows a nital-etched micrograph according to the embodiment of FIG. 8 of a ledeburitic cast iron material that has a hardness of 49 HRC, namely on a scale of 200:1.

DETAILED DESCRIPTION OF THE PREFERRED EMBODIMENTS

Figure 3:
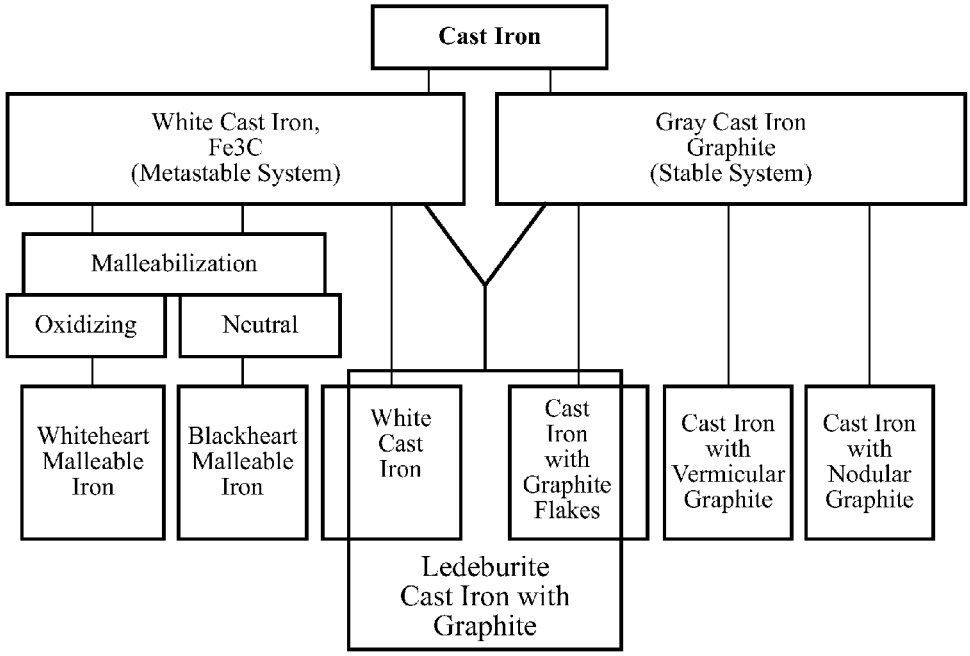
FIG. 3 shows an overview diagram of possible cast iron formations, particularly the overlapping region of the ledeburitic cast iron with graphite (material according to the invention).

The invention pertains to a cast iron material for the manufacture of wear-resistant and corrosion-resistant sliding rings for use in running gear seals that run at high peripheral speeds (>5 m/s) and/or in which the running gear seals have a large diameter (=>600 mm) and/or for cylinder liners.

The invention makes available a cast iron material of ledeburitic cast iron with free and evenly distributed graphite formation, particularly graphite flakes and/or vermicular graphite and/or nodular graphite, which has a high carbide content of at least 15 wt. %.

The material made available by the invention resembles white cast iron, for example, Ni-Hard 1 and Ni-Hard 2. In comparison with pure white cast iron, the material made available by the invention, however, additionally features a characteristic free, evenly distributed graphite formation (graphite flakes and/or vermicular graphite and/or nodular graphite).

Depending on the respective application, the basic matrix of the ledeburitic cast iron material made available by the invention may be realized in pearlitic and/or bainitic and/or martensitic form.

Due to the intense, even distributed graphite formation, the material made available by the invention has a thermal conductivity that is three to four times greater than that of white cast iron materials (Ni-Hard).

The material made available by means of the invention makes it possible to achieve a superior thermal conductivity in comparison with white cast iron materials such as Ni-Hard, wherein the frictional heat of the sliding surfaces generated in running gear seals consequently can be carried off in a correspondingly improved fashion.

Due to the improved thermal conductivity of the cast iron material made available by the invention, the sliding surfaces of the running gear seals and a lubricant such as, for example, oil are not overheated such that no scoring occurs on the sealing surfaces, namely even at higher peripheral speeds (>5 m/s) of the running gear seals.

Another advantage of the material made available by the invention can be seen in the high wear resistance that is achieved due to the high carbide content of at least 15 wt. %.

In addition, the alloying elements chromium (Cr), vanadium (V), molybdenum (Mo) and nickel (Ni) provide the material made available by the invention with the required corrosion resistance.

According to one preferred embodiment of the present invention, the material made available by the invention consists of cast iron, particularly ledeburitic cast iron with evenly distributed graphite formation and a carbide content of at least 15 wt. %, wherein the cast iron contains:

2.5-5.0 wt. %, preferably 4.1-5.0 wt. %, carbon (C),
1.0-3.0 wt. %, preferably 1.0-1.8 wt. %, silicone (Si),
no more than 1.0 wt. %, preferably 0.6-1.0 wt. %, manganese (Mn),
no more than 0.8 wt. %, preferably 0.5 wt. %, phosphorus (P),
no more than 0.3 wt. %, preferably 0.1 wt. %, sulphur (S),
no more than 10.0 wt. %, preferably 4.0 wt. %, chromium (Cr),
no more than 3.0 wt. %, preferably 1.0 wt. %, copper (Cu),
no more than 3.0 wt. %, preferably 1.0 wt. %, molybdenum (Mo),
no more than 0.25 wt. %, preferably 0.2 wt. %, tin (Sn),
no more than 4.0 wt. %, preferably 3.0 wt. %, nickel (Ni),
no more than 3.0 wt. %, preferably 0.5 wt. %, vanadium (V), as well as
iron and manufacturing-related impurities as the remainder.

It was possible to verify in experiments that a material of the above chemical percent-by-weight composition also fulfills a corresponding sealing effect (sealing function) in a largely optimal fashion at peripheral speeds of 9 m/s and a seal diameter (D) of 1105 mm.

In addition, scoring or leakage of the material made available by the invention could not be observed in the sealing region of the running gear seal.

Another advantage of the ledeburitic cast iron material made available by the invention in comparison with conventional materials such as those cited in the state of the art can be seen in the greater wear resistance in connection with an adequate corrosion resistance.

Consequently, the ledeburitic cast iron material with graphite made available by the invention makes it possible to realize special applications, for example, with high peripheral speeds (>5 m/s) and a large diameter (D>600 mm) of the running gear seals which could not be realized until now with materials known from the state of the art such that corresponding technical improvements can be achieved on the sector of running gear seals.

FIG. 1 shows possible cast iron formations.

In this case, the cast iron is divided into white cast iron and gray cast iron.

The white cast iron, for example Fe—$Fe_3C_9$, is formed in a metastable system in this case. Until now, the white cast iron materials used such as, for example, Ni-Hard 1 through Ni-Hard 4 were manufactured without a corresponding evenly distributed graphite formation. The microstructure is ledeburitic in this case.

In this context, the term ledeburite refers to a carbide matrix with pearlite or martensite or bainite. The advantage of this material is based on that it has a very high wear resistance and corrosion resistance, but only a very low thermal conductivity of approximately 12 W/(m*K).

On the other hand, the term gray cast iron refers to a corresponding cast iron with evenly distributed graphite formation in a stable (Fe—C) system.

In this case, the gray cast iron can be divided into cast iron with graphite flakes, cast iron with vermicular graphite and cast iron with nodular graphite. The result is a softer, less wear and corrosion-resistant cast iron that, however, has a very high thermal conductivity. GJL (ISO abbreviation for graphite flakes), in particular, has a thermal conductivity of approximately 45 W/(m*K).

FIG. 2 shows a micrograph detail of a ledeburite microstructure with martensite using the example of Ni Hard 1, namely on a scale of 100:1. In this case, the brighter colored formations (phases) of the carbides originate from the ledeburite. The darker regions (phases) are martensite.

FIG. 3 shows a diagram of the ledeburitic cast iron with graphite which corresponds to FIG. 1, however, with an overlapping region between white cast iron and gray cast iron.

Figure 4:
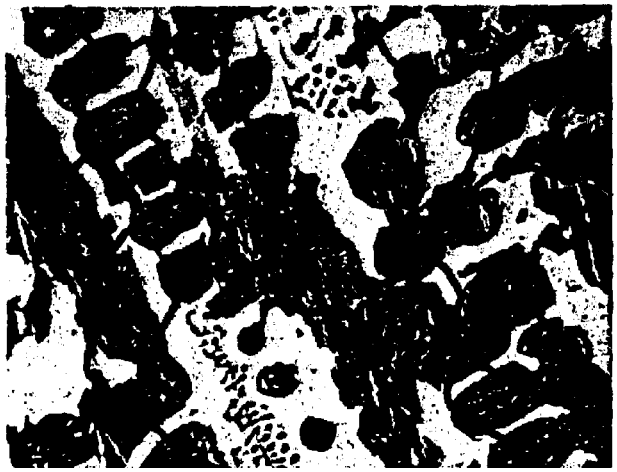
FIG. 4 shows a schematic micrograph of ledeburite with martensite formation and graphite flakes on a scale of 100:1, wherein the graphite flakes were drawn in schematically.

A corresponding schematic micrograph detail is illustrated in FIG. 4. In contrast to FIG. 2, the desired graphite flakes are drawn in schematically in this case.

In order to realize the desired microstructure with evenly distributed graphite formation, a high carbon content (C) of at least 4 wt. %, a low percent-by-weight silicone content of <1.8%, a purposeful inoculation treatment of the molten mass which depends on the wall thickness and corresponding alloying additives such as nickel (Ni), chromium (Cr), molybdenum (Mo), manganese (Mn), phosphorus (P), etc., are required.

Figures 5, 6:
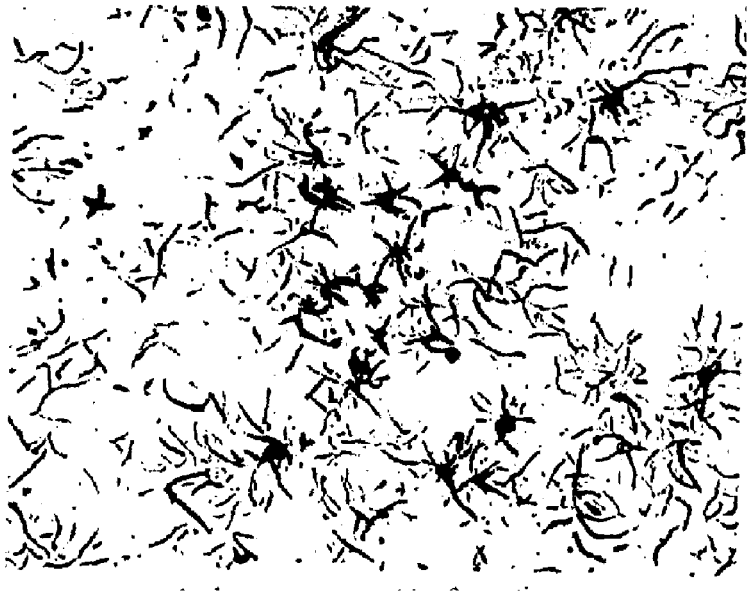
FIG. 5 shows a first exemplary percent-by-weight chemical embodiment of the ledeburitic cast iron material that has a hardness of 39 HRc.
FIG. 6 shows an unetched micrograph of a ledeburitic cast iron material according to the preferred embodiment of FIG. 5 which has a hardness of 39 HRc, as well as a corresponding evenly distributed graphite formation, on a scale of 100:1.

FIG. 5 shows a preferred percent-by-weight chemical embodiment of the ledeburitic cast iron material with free, evenly distributed graphite formation and a carbide content of at least 15.0 wt. %.

One preferred embodiment of the invention contains the following percent-by-weight fractions:

| | |
|---|---|
| Carbon (C) | 4.1 wt. % |
| Silicone (Si) | 1.7 wt. % |
| Manganese (Mn) | 0.6 wt. % |
| Phosphorus (P) | 0.4 wt. % |
| Sulphur (S) | 0.08 wt. % |
| Chromium (Cr) | 1.7 wt. % |
| Nickel (Ni) | 2.0 wt. % |
| Molybdenum (M) | 0.0 wt. % |
| Vanadium (V) | 0.3 wt. % |
| Copper (Cu) | 0.0 wt. %, as well as |
| iron and manufacturing-related impurities as the remainder. | |

The corresponding evenly distributed graphite formation of the cast iron material made available by the invention is illustrated in the micrograph of FIG. 6. This figure shows an unetched micrograph with corresponding evenly distributed graphite formation on a scale of 100:1.

Figures 7, 8:
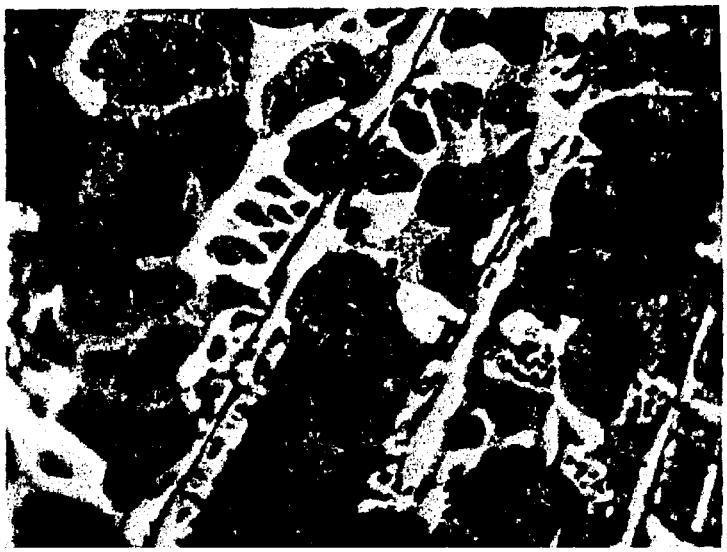
FIG. 7 shows a nital-etched micrograph according to the embodiment of FIG. 5 of a ledeburitic material that has a hardness of 39 HRC, namely on a scale of 500:1.
FIG. 8 shows a second exemplary percent-by-weight chemical embodiment of a ledeburitic cast iron material that has a hardness of 49 HRC.

FIG. 7 shows other details of the ledeburitic cast iron material made available by the invention which is illustrated in the micrograph of FIG. 6. In this case, the material cut was etched with nital in order to improve the visibility of other phase details in the cast iron material such as, for example, carbide of the ledeburite (white), pearlite of the ledeburite (gray) and graphite (black), namely on a scale of 500:1.

Another preferred percent-by-weight chemical embodiment of the present invention is illustrated in FIG. 8. In this case, a preferred embodiment of the ledeburitic cast iron material with free, evenly distributed graphite formation and a high carbide content of at least 15 wt. % has the following percent-by-weight chemical composition:

| | |
|---|---|
| Carbon (C) | 4.2 wt. % |
| Silicone (Si) | 1.7 wt. % |
| Manganese (Mn) | 0.6 wt. % |
| Phosphorus (P) | 0.4 wt. % |
| Sulphur (S) | 0.08 wt. % |
| Chromium (Cr) | 3.0 wt. % |
| Nickel (Ni) | 3.0 wt. % |
| Molybdenum (M) | 0.9 wt. % |
| Vanadium (V) | 0.35 wt. % |
| Copper (Cu) | 0.0 wt. %, as well as |
| iron and manufacturing-related impurities as the remainder. | |

A corresponding evenly distributed graphite formation of the ledeburitic cast iron material is illustrated in FIG. 9. This figure shows an unetched micrograph of the inventive cast iron material with corresponding evenly distributed graphite formation on a scale of 100:1.

Other details of the micrograph of FIG. 9 are illustrated in FIG. 10. In this case, the ledeburitic cast iron material was cut and etched with nital in order to improve the visibility of other details such as carbide of the ledeburite (white), bainite and martensite of the ledeburite (bright gray) and graphite, as well as ribbon-grained pearlite (black), namely on a scale of 500:1.

Additional details of the micrograph of FIG. 9 are also illustrated in FIG. 11.

In this case, the material cut was also etched with nital in order to improve the visibility of other details such as carbide of the ledeburite (white), bainite and martensite of the ledeburite (bright gray) and graphite with ribbon-grained pearlite (black), namely on a scale of 200:1.

Although the invention was specifically described with reference to the presented embodiments, it should be quite obvious to persons skilled in the art who are familiar with the state of the art that modifications on or in the form or in details can be carried out without deviating from the character and the protective scope of the invention defined in the attached claims.

The invention claimed is:

1. A wear-resistant and corrosion-resistant axial face seal having a diameter of greater than 600 mm and high thermal conductivity for sealing a gear running at peripheral speeds greater than 5 m/s, comprising a material of ledeburitic cast iron containing graphite, wherein the graphite is evenly distributed and in a free formation, the ledeburitic cast iron has a carbide content of at least 15.0 wt. %, and the ledeburitic cast iron contains:

4.1-4.2 wt. % carbon (C), 1.7 wt. % silicone (Si), 0.6 wt. % manganese (Mn), 0.4 wt. % phosphorus (P), 0.08 wt. % sulphur (S),
1.7-3.0 wt. % chromium (Cr),
0-0.9 wt. % molybdenum (Mo),
2.0-3.0 wt. % nickel (Ni),
0.3-0.35 wt. % vanadium (V), as well as
iron and manufacturing-related impurities as the remainder.

2. An axial face seal according to claim 1, wherein the ledeburitic cast iron contains a mixture of white cast iron and gray cast iron in an arbitrary mixing ratio.

3. An axial face seal according to claim 1, wherein the free graphite formation comprises graphite flakes.

4. An axial face seal according to claim 1, wherein the basic matrix of the ledeburitic cast iron is pearlitic.

5. An axial face seal according to claim 1, wherein the ledeburitic cast iron is hardened and/or annealed by means of a heat treatment.

6. An axial face seal according to claim 1, wherein the ledeburitic cast iron is nitride-hardened or surface-coated.

7. An axial face seal according to claim 1, is suitable for high peripheral speeds of 9 m/s and/or a diameter of 1105 mm.

8. An axial face seal according to claim 1, wherein the free graphite formation comprises graphite flakes and/or vermicular graphite and/or nodular graphite.

* * * * *